United States Patent [19]

Brint et al.

[11] 4,453,329

[45] Jun. 12, 1984

[54] FIREARMS WITH ROTARY MAGAZINES

[75] Inventors: Norman T. Brint, Waltham Abbey; Jack W. Comley, Cheshunt, both of England

[73] Assignee: The Secretary of State for Defence in Her Britannic Majesty's Government of the United Kingdom of Great Britain and Northern Ireland, London, England

[21] Appl. No.: 361,924

[22] PCT Filed: Jul. 1, 1981

[86] PCT No.: PCT/GB81/00123

§ 371 Date: Mar. 15, 1982

§ 102(e) Date: Mar. 15, 1982

[87] PCT Pub. No.: WO82/00347

PCT Pub. Date: Feb. 4, 1982

[30] Foreign Application Priority Data

Jul. 14, 1980 [GB] United Kingdom ..... 8022930

[51] Int. Cl.[3] ..... F41C 13/00

[52] U.S. Cl. ..... 42/15; 42/39.5; 42/19

[58] Field of Search ..... 42/5, 15, 27, 39.5, 42/59, 19; 89/33 MC

[56] References Cited

U.S. PATENT DOCUMENTS 3,745,687 7/1973 Koon ..... 42/19

FOREIGN PATENT DOCUMENTS

| | | |
|---|---|---|
| 421521 | 6/1937 | Belgium . |
| 24672 | 10/1883 | Fed. Rep. of Germany . |
| 34264 | 1/1886 | Fed. Rep. of Germany . |
| 45875 | 1/1889 | Fed. Rep. of Germany . |
| 194228 | 1/1908 | Fed. Rep. of Germany . |
| 330336 | 12/1920 | Fed. Rep. of Germany . |
| 966589 | 10/1950 | France . |
| 1037668 | 9/1953 | France . |
| 9373 | 11/1894 | Switzerland . |
| 20275 | of 1914 | United Kingdom . |

*Primary Examiner*—Stephen C. Bentley

*Attorney, Agent, or Firm*—Cushman, Darby & Cushman

[57] ABSTRACT

A firearm especially for firing large calibre rounds such as rubber bullets and having a rotary magazine which is rechargeable at any stage of depletion. A loading arm serves to guide rounds through an inlet opening in the magazine, in such a way that they are received into corresponding locations in a rotating carrier, and the carrier rotates forward one position with each additional round. Until the penultimate round, the guide means is locked to the magazine body. In this position, it obstructs further movement of the first-inserted round and thus prevents insertion of the final round. Mechanism is described by which, on insertion of the final round the guide means automatically unlocks from the magazine body and locks to the rotating carrier. In this condition it serves to keep the first inserted round locked in the magazine as it completes a full rotation to come opposite the inlet opening once more. Mechanism for firing automatic indexing the carrier, and automatic extraction and ejection of spent cartridges is described.

14 Claims, 9 Drawing Figures

FIREARMS WITH ROTARY MAGAZINES

Figure 1:
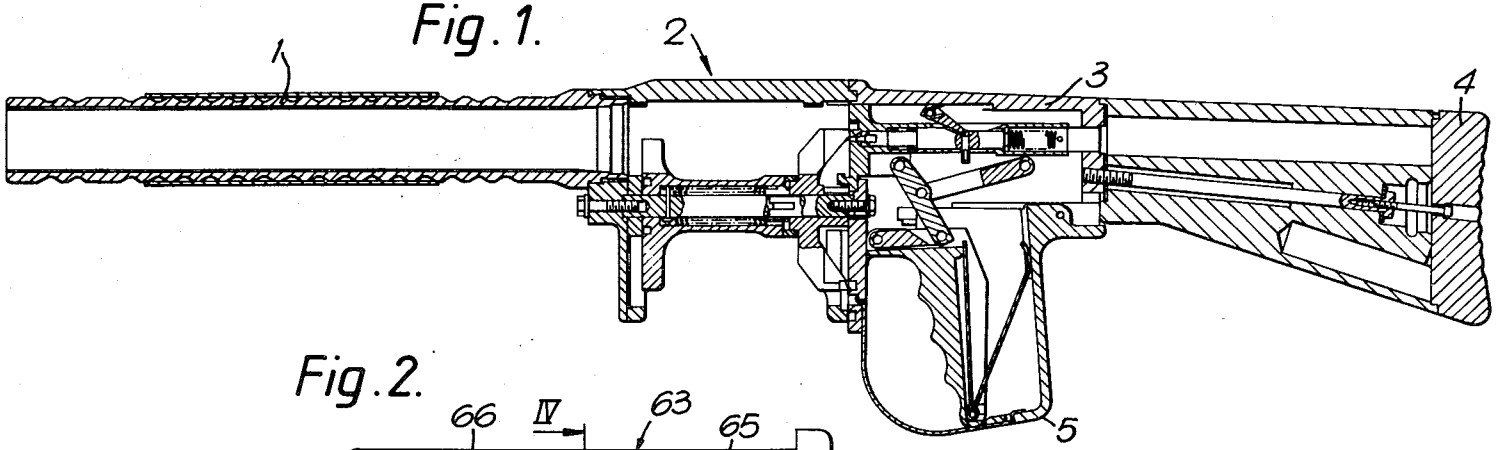

The present invention relates to firearms, and in particular to a re-chargeable magazine for a firearm. The invention is especially concerned with the provision of a firearm having a rotary magazine which can automatically supply a fresh round to the breech of a firearm so as to be ready for a fresh firing sequence to commence as soon as a spent case has been ejected.

Considerable importance is attached nowadays to obtaining a maximum of performance from a firearm with a minimum of bulk. The user requires an efficient weapon which is portable with the minimum of inconvenience. Magazines of firearms according to the present invention are capable of accommodating a number of rounds of ammunition therein so as to use space more economically than has previously been thought possible.

This factor is of particular importance in a weapon capable of firing ammunition of relatively large calibre, e.g. 4 cm, such as for example rounds comprising projectiles in the form of the so-called "rubber bullets", gas canisters, or grenades or other fragmentation devices. Accordingly the present invention has particular but not exclusive application to firearms of this type. Conventional practice is to provide a disposable magazine, so that when one magazine is exhausted it is removed and replaced by a fresh magazine, already loaded with fresh ammunition. Unless he throws away a magazine which is only partially exhausted, the user may therefore run out of ammunition and be obliged to change magazines at an extremely inconvenient moment. Normally there has been no possibility of re-charging a partially exhausted magazine without disengaging the magazine from the firearm. Where the firearm is for large calibre ammunition, this problem can be particularly acute because considerations of bulk prevent the use of a magazine capable of holding more than a few rounds.

An advantageous feature of the present invention is that it makes possible the provision of a magazine which can be re-loaded at any time with any number of rounds of ammunition up to its maximum capacity, without the necessity for removal of the magazine from the firearm.

According to the present invention, there is provided a firearm having a rotary magazine comprising a magazine body defining around part of its circumference an opening through which a round of ammunition can be inserted or withdrawn, and around a remaining part of its circumference defining a circumferential restraint through which a round cannot be inserted or withdrawn;

a carrier rotatable within the body about a carrier axis and having radially extending portions adjacent pairs of which define positive locations in which a round of ammunition can be accommodated on insertion through the opening, rounds being slideable longitudinally in said positive locations;

resilient carrier biasing means for urging the carrier to rotate in a particular bias direction;

a guide member moveable across the opening;

said guide member having a guide surface facing against the bias direction so that a round inserted through the opening is guided into one of said positive locations and simultaneously rotates the carrier against its bias;

said guide member having a round-retaining surface facing in the bias direction which can co-operate with one of the positive locations to positively retain the first-inserted round against circumferential and radial movement; and restraining means for holding the guide member in a position such that the guide surface faces the opening whenever the carrier occupies the position corresponding to one in which the magazine contains less rounds of ammunition than its maximum capacity, the guide member being moveable against the bias direction during movement of the carrier corresponding to insertion of the final round so that the first-inserted round may then pass through the position occupied at other times by the guide means.

Conceivably the guide member restraining means might comprise a resilient guide bias means urging the guide member to move in the bias direction against a stop.

Advantageously, however, the restraining means comprises first locking means for positively locking the guide member to the body whenever the magazine contains less rounds of ammunition than its maximum capacity, the locking means being releasable automatically when the carrier moves against the bias direction as the final round is inserted.

Preferably second locking means are provided for positively locking the guide member to the carrier during insertion of the final round when the first-inserted round is positively held between its positive location in the carrier and the round-retaining surface of the guide member. In a convenient arrangement, the first and second locking means comprise a detent member slideable in a bore passing through the guide member in the direction of the carrier axis, said detent member being of such a length as to project from a surface of the guide member at all times, a projecting end of the detent member being constrained by contact of its other end with an end face of the carrier to remain within a first depression in the body whenever the carrier occupies the position corresponding to one in which the magazine contains less rounds of ammunition than its maximum capacity, a second depression being provided in the said end face of the carrier into which the said other end of the detent member can move so that it clears the first depression during movement of the carrier corresponding to insertion of the final round.

Advantageously, means are provided for limiting the maximum rotation of the carrier relative to the magazine body. Thus it can be ensured that a positive bias of the resilient bias means is always maintained.

The means for limiting the maximum rotation of the carrier can conveniently be in the form of a stop on the carrier which cannot pass the detent member.

In a convenient arrangement, there is provided an annular groove in the end face of the carrier into which the detent member is constrained at all times to project by contact with the body, the second depression being provided in the base of the annular groove and the stop being in the form of an obstruction in the groove.

Carrier indexing means are normally provided for holding the carrier in positions such that each successive round of ammunition can be held against the carrier biasing means aligned in the breech with the barrel.

Conveniently the carrier indexing means is a ratchet device acting between the carrier and the body.

Advantageously the firearm is provided with a longitudinally moveable breech block which can push forward a round of ammunition in a positive location in the carrier aligned with the barrel to engage the round positively with the breech end of the barrel.

Advantageously the firearm is provided with a longitudinally moveable firing pin which can move forward to strike the rear face of a round of ammunition only when the breech block occupies a forward position.

Preferably the firing pin has a mechanical interaction with the carrier indexing means such that after the breech block has pushed a round of ammunition fully forward and the firing pin has reached a forward position in which it can fire the round of ammunition, the carrier indexing means is disengaged to permit the carrier to turn to a position where the next successive round is brought into alignment with the breech.

Desirably the carrier indexing means comprises a catch having a slotted pivotal mounting on the body, the catch being biased towards a position where it engages one of a number of spaced projections on the carrier to restrain rotation thereof, and the said mechanical interaction comprises means for disengaging the catch when the firing pin is retracted with the breech block from its most forward position, the catch immediately returning by reason of its slotted pivotal mounting to a position clear of the said one projection where it can engage the next succeeding projection on subsequent rotation of the carrier under its resilient bias.

Preferably the breech block has a lip which can engage around the rim of a round aligned therewith, so that after firing the spent case of a round can be withdrawn longitudinally by rearward movement of the breech block.

When the spent case is thus withdrawn into alignment with the magazine opening, if the carrier catch has been freed, the carrier thus indexes around to bring the next round in the magazine (if any round is present) into alignment with the barrel, and to eject the spent case through the opening under the force exerted by the carrier bias and guided by the guide surface of the guide member.

Figure 2:
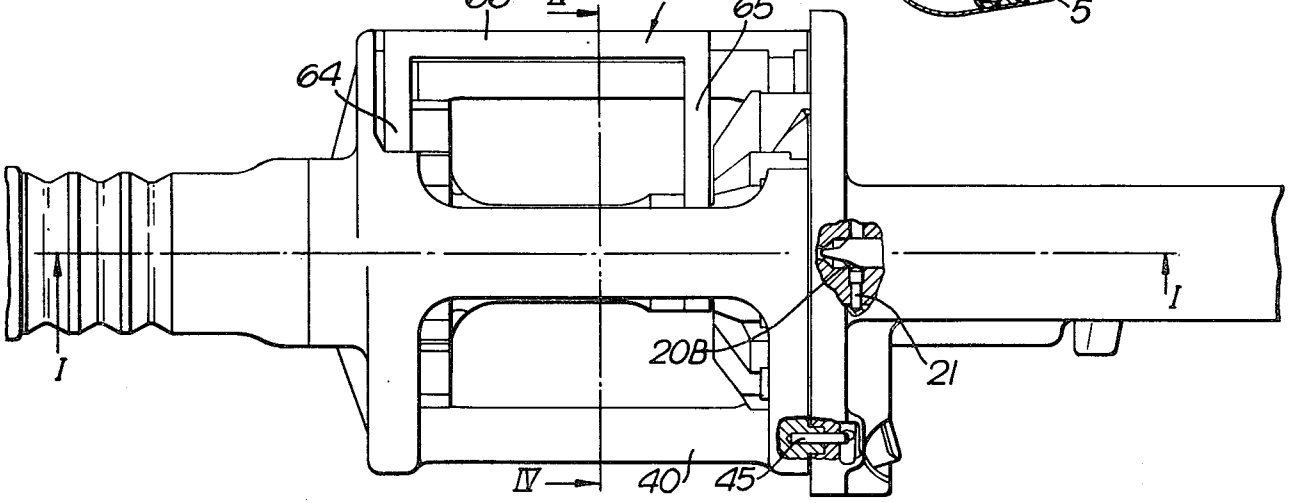
Figure 1A:
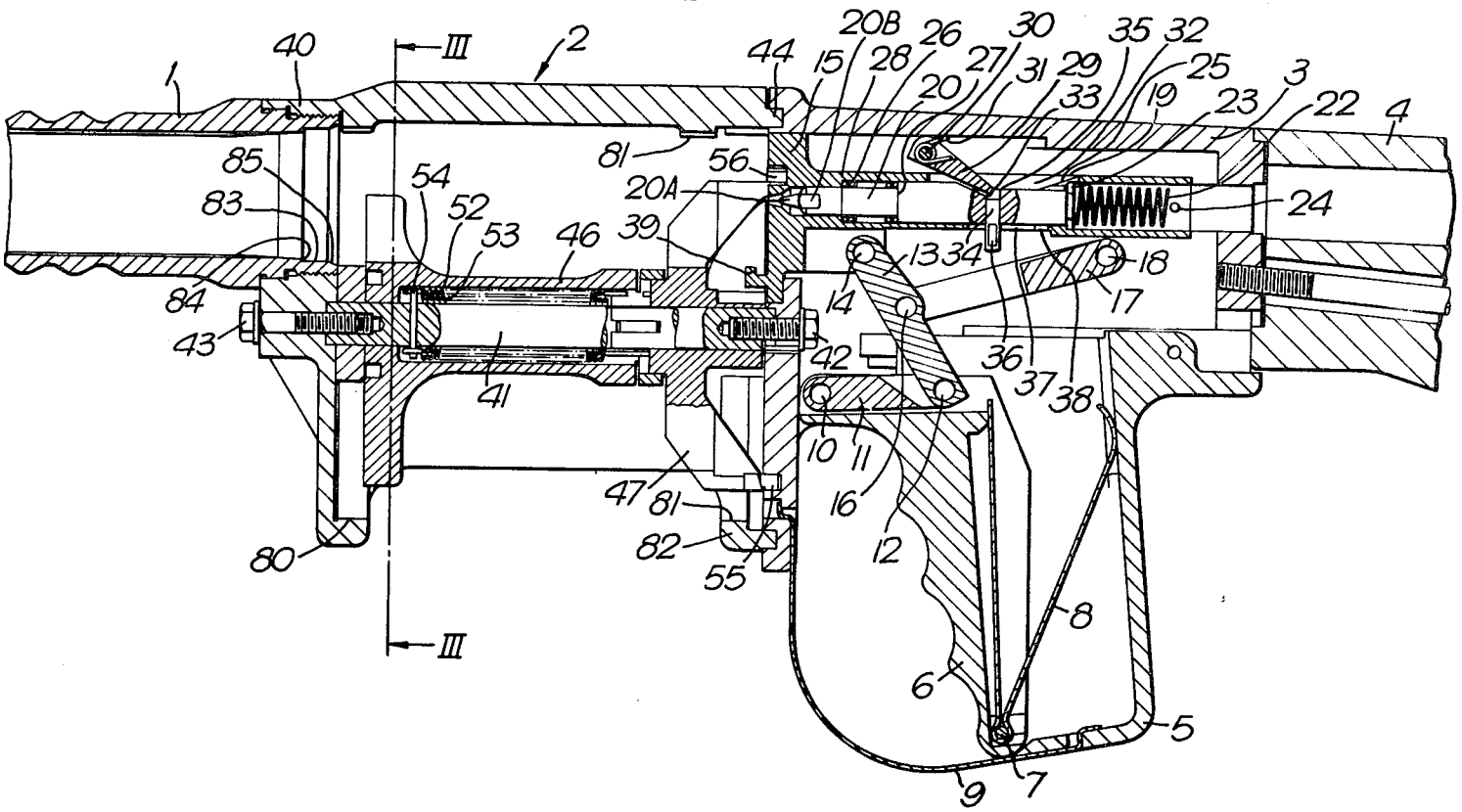
Figure 3:
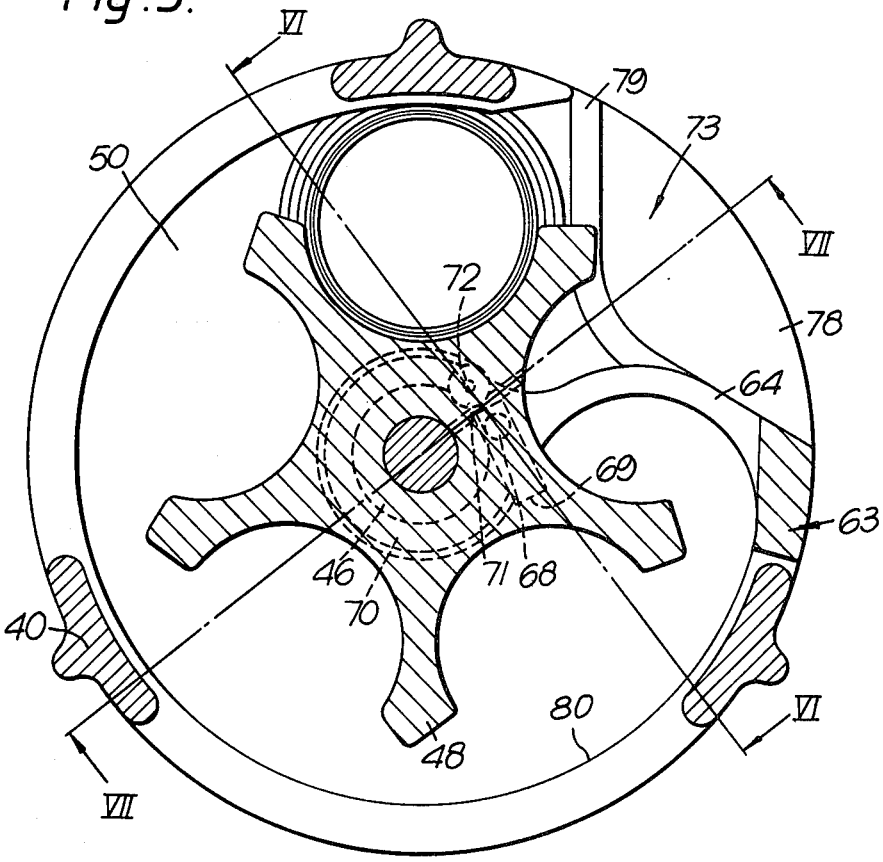
Figure 6:
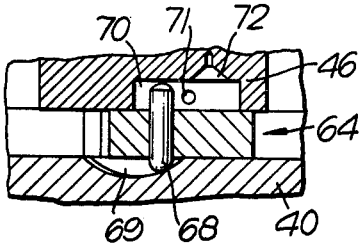
Figure 7:
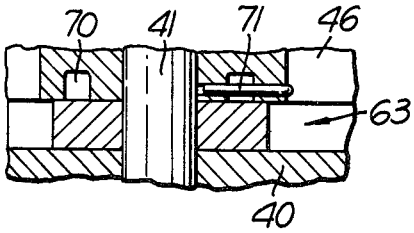
Figure 4:
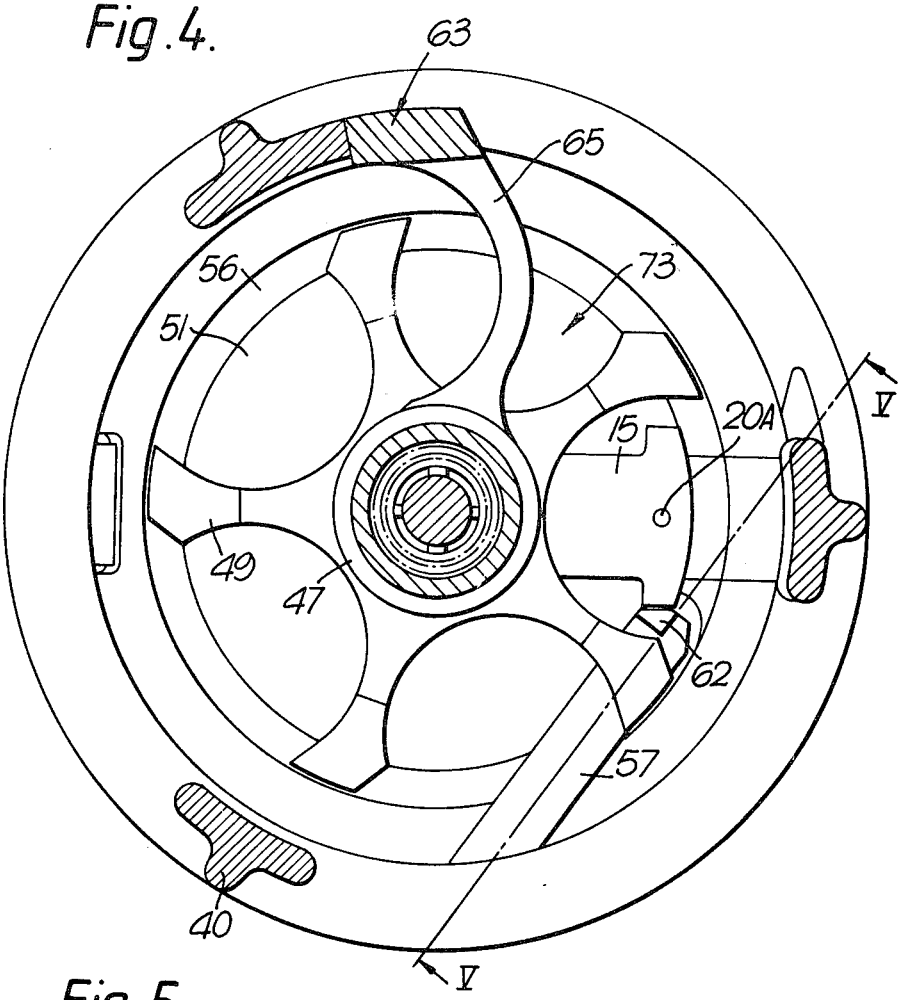
Figure 5:
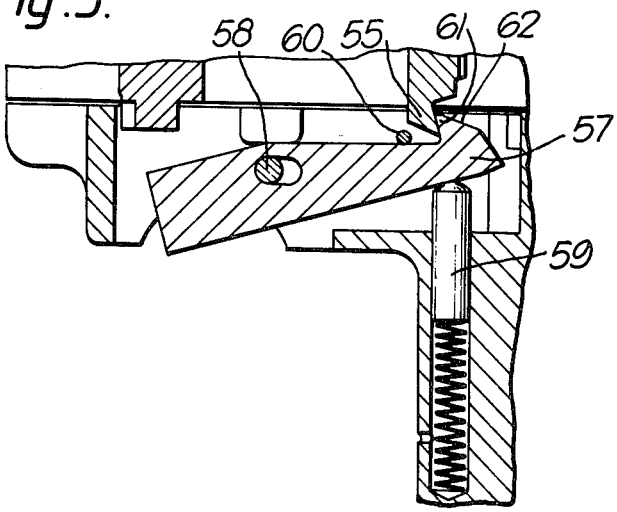
Figure 8:
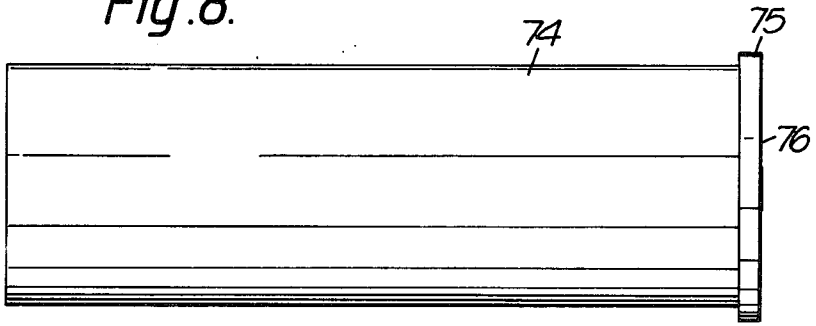

The invention will now be described by way of example only with reference to the accompanying drawings, in which FIG. 1 is a side elevational view on the line I—I of FIG. 2 of an embodiment of firearm in accordance with the invention, FIG. 1A shows a part of FIG. 1 to an enlarged scale, FIG. 2 is a plan view part in section, of a part of the firearm shown in FIG. 1, FIG. 3 is a sectional end elevation on the line III—III of FIG. 1A, FIG. 4 is a sectional end elevation on the line IV—IV of FIG. 2, FIG. 5 is a sectional part view on the line V—V of FIG. 4, FIG. 6 is a sectional part view in the line VI—VI of FIG. 3, FIG. 7 is a sectional part view on the line VII—VII of FIG. 3, FIG. 8 is a side elevational view of a round of ammunition suitable for use in the firearm of FIGS. 1 to 7, and FIG. 9 is an end elevational view of the round of ammunition shown in FIG. 8.

As seen in FIGS. 1 to 7, a self-loading firearm comprises a barrel 1, a rotating magazine assembly 2, a firearm body 3 housing a breech block and firing mechanism, a butt assembly 4 and a pistol grip 5. A trigger 6 is pivoted at 7 in the base of the pistol grip 5, and is biased to rotate anticlockwise about the pivot 7 by means of a double leaf spring 8 stressed against the rear of the pistol grip 5. A trigger guard 9 protects the trigger against accidental operation.

Pivoted at 10 to the forward upper portion of the trigger is a link member 11, which extends generally rearwardly from its pivot point 10. Pivotally fixed at a pivot point 12 to the rear end of the link member 11 is a rearward extension of a first toggle bar 13. Toggle bar 13 is pivotally connected at its forward end by pivot 14 to a breech block 15 slideable longitudinally in the body 3. Pivotally connected by a pivot 16 to an intermediate point on the first toggle bar 13 is a second toggle bar 17 which extends rearwardly from the pivot 16, and is itself pivoted by a pivot 18 to the body 3.

Slideable longitudinally within a channel 19 in the breech block 15 is a firing pin 20 having a hardened forward tip portion 20A, and a side cheek 20B which can bear on a pin 21 held captive in a transverse bore in the body 3. (FIG. 2)

A strong helical compression spring 22 provided with a thrust cap 23 is located rearwardly of the firing pin 20 in the bore 19 between a retaining pin 24 and a shoulder 25 of the bore 19. A relatively weak helical return compression spring 26 is also located in the bore 19 between a forward-facing shoulder 27 on the firing pin 20 and a shoulder 28 of the bore 19.

A sear 29 pivoted to the body 3 by pivot 30 is urged to turn clockwise (as viewed in FIG. 1) about the pivot 30 by a spring 31, towards engagement with the firing pin 20. The tip of the sear 29 can engage, through a longitudinal slot 32 in the breech block 15 with a bent 33 on the firing pin 20, to restrain the firing pin from forward movement. A sear control pin 34 of generally cylindrical form can slide in a transverse bore 35 in the firing pin 20. The pin 34 has a flat 36 formed on its lower portion, but not extending to its lower end. The width of the pin 34 at the section of the flat 36 is such as to permit that section of the pin to slide along a longitudinal slot 37 in the breech block 15 which is of a width less than the full diameter of the pin 34. The length of the flat 36 in the direction of the pin axis is such as to permit a limited sliding transverse movement along the bore 35, but escape of the pin 34 is prevented by abutment of its full diameter portions against the edges of the slot 37. During assembly, the pin enters the slot 37 through a keyhole 38 in the breech block 19, but during normal operation of the firearm the relative movement of the firing pin 20 and the breech block 19 is limited so that the pin 34 does not become aligned with the keyhole 38.

The magazine assembly 2 comprises a magazine body 40 and a spindle 41. The spindle is secured to the firearm body 3 by means of a screw 42, and the magazine body 40 is secured to the spindle by means of a screw 43. A spigot 44 on the body 40 locates within a corresponding socket on the body 3 and correct alignment is ensured by an alignment pin 45 (FIG. 2) secured to the body 40 and fitting closely within a corresponding alignment recess in the body 3. Mounted for rotation on the spindle 41 is a star wheel assembly comprising a forward star wheel 46 and a rearward star wheel 47 locked to rotate together by means of dogs. The star wheels 46, 47 are of mutually similar transverse cross-section as best seen in FIGS. 3 and 4, each comprising respectively five evenly spaced radially-extending arms 48, 49 shaped to define a slightly less than semi-circular recess 50, 51 between each adjacent pairs of arms, the recesses of the two star wheels being axially aligned with one another. The star wheel assembly 46, 47 is urged to rotate in a clockwise direction as viewed in FIG. 3, by means of a pair of helical torsion spring 52, 53 mounted around the spindle 41. At their forward end, the springs 52, 53 have tails which bear against a cross-pin 54 to restrain rotation around the spindle. At their rearward ends, the springs 52, 53 have tails which engage in corresponding holes in the forward face of the star wheel portion 47. Thus when the star wheel assembly 46, 47 is turned anticlockwise (as viewed in FIG. 3), a torsional restoring force is provided by springs 52, 53. A certain degree of torsion is imparted to the springs 52, 53 during assembly so that they bias the star wheel assembly to turn clockwise as viewed in FIG. 3.

Each arm of the star wheel 47 is provided with a rearwardly projecting tail 55 which runs freely, as the star wheel rotates, in an annular recess 56 in the adjacent end face of the body 3. As seen in FIG. 5, a catch 57 having a slotted pivotal mounting 58 in the body 3 is urged forwardly by the action of a spring loaded plunger 59, the forward movement of the catch being limited by a stop pin 60. The catch 57 has a hooked portion 61 adapted, when in its forward position, to engage and restrain an adjacent tail 55. The catch 57 also has a cam face 62 engageable by the outer end of the pin 21.

A loading arm 63 is provided comprising a pair of curved arms 64, 65 freely pivoted respectively on the spindle 41 just ahead of the star wheel 46, and on a boss formed on the forward portion of the star wheel 47. The arms 64, 65 are linked rigidly together by a longitudinally extending guide bar 66.

Referring particularly to FIGS. 3, 6 and 7, a floating pin 68 received in a longitudinal bore in the forward curved arm 64, where it is held captive between the front face of the star wheel 46 and the rearward face on the body 40. As shown, the forward end of the pin 68 is received in a curved depression 69 in the forward face of the body 40, and the rearward end of the pin 68 is received in an annular grove 70 in the forward face of the star wheel 46. A cross pin 71 fixed by adhesive in a radial bore in the star wheel 46 extends across the groove 70 and acts as a stop to prevent the star wheel assembly 46, 47 making substantially more than a single revolution relative to the loading arm 63.

The pin 68 is of a greater length than the depth of the groove 70 plus the thickness of the forward curved arm 64, so that normally the pin 68 projects into the depression 69 so that the loading arm 63 is locked stationary with the body 40, while the star wheel assembly can rotate relative thereto, the groove 70 providing clearance for the pin 68.

A conical depression 72 is provided in the base of the groove 70, adjacent the cross pin 71. When the star wheel assembly 46, 47 has completed almost a full revolution relative to the body 40 from the position illustrated, the end of the pin 68 within the groove 70 can enter the depression 72, which is of sufficient depth to enable the other end of the pin 68 to clear the depression 69. The loading arm 63 can then move relative to the body 40 between limits set by an opening 73 for the insertion of rounds of ammunition therein, the disengagement of the pin being facilitated by the curved shape of the depression 69. During this movement the star wheel 46 and the loading arm 63 are locked together by the pin 68.

Figure 9:
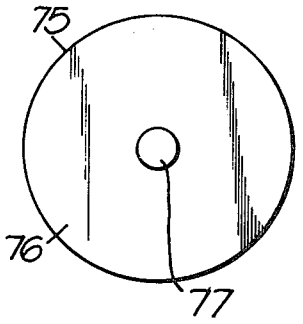

The round of ammunition for which the firearm is designed is shown in FIGS. 8 and 9. It comprises a cylindrical case 74 which contains a projectile (not shown) such as for example a so-called rubber bullet. The round is also provided with a projecting rim 75 at its rearward end, and in the rearward face 76 there is provided a percussion cap 77 by which the rounds may be fired. The case is designed so as to be substantially self-supporting, i.e. insertion into a supporting chamber to prevent rupture of the case when the round is fired is unnecessary.

Rounds may be inserted into the magazine through the opening 73. Entry of a fresh round is facilitated by a recessed portion 78 on the forward face of the magazine body 40, bounded by a chamfered portion 79. After insertion through the opening, a round is located in a corresponding pair of recesses 50, 51 which provide a positive location therefor in the star wheels 46, 47. As the star wheel assembly is rotated, the forward end of the casing 74 is restrained from radially outward movement by a part-circular rim 80 which extends around the whole of the forward face of the body 40 with the exception of the region of the opening 73 (see FIG. 3). At the rear end, the casing is restrained from radially outward movement by an arcuate rim 81. The casing is restrained from axial movement around the whole circumference of the body except the region of the opening 73 and the breech region, by a radially inwardly directed lip 82 behind which the rim 75 locates. In the region of the breech, the round is restrained axially by a lip 39 on the breech block 15. The concave surfaces of the curved arms 64, 65 of the loading arm 63 are approximately semi-circular for a reason explained hereinafter, the radius being approximately equal to that of the casing 74.

The barrel 1 is provided at its breech end with a very short chamber in the form of a socket portion 83 in which the forward end of a round can be received. The socket portion 83 has a shoulder 84 which the round cannot pass, and entry to the chamber is facilitated by a short chamfered section 85.

In use of the firearm, any number of rounds up to five may be placed in the magazine by successive insertion through the opening 73. As the first round is inserted, its entry is facilitated by the recess 78 and chamfered portion 79. The loading arm 63 is locked by the pin 68 in the position illustrated. The loading arm hence cannot pivot to a position where it hinders entry of the round. As the round is pressed inwardly into position the arms 64, 65 guide the round so that it moves also in an anticlockwise direction (as viewed in FIG. 3), towards alignment with the barrel, i.e. towards the breech position. The casing 74 of the round thus bears on the arms 48, 49 of the star wheels 46, 47 to move the star wheels anticlockwise (as viewed in FIG. 3), against the torsional bias of the springs 53, 54 until the round is fully received in a corresponding pair of recesses 50, 51. As the round reaches the position where it is aligned with the barrel 1 the hook 61 of the catch 57, under the action of the spring-loaded plunger 59, snaps into place behind the tail 55 of an arm 49. The star wheel assembly is hence held in this position against the bias of the springs 53, 54 by a ratchet action of the catch 57, with the round in the breech aligned with the barrel.

A second, third and fourth round may be inserted in exactly the manner described above. As the rounds move around the magazine they are restrained inwardly in the recesses 50, 51 of the star wheels 46, 47 and outwardly by rims 80, 81 whilst longitudinal movement of the rounds is restrained by lips 39 and 82 engaging rims 75.

However, when it is desired to insert a fifth round, the loading arm obstructs the path of the first round. This difficulty is overcome as follows. As the fifth round is inserted, the star wheel 46 moves to the position in which the recess 72 comes into alignment with the pin 68. As the first round pushes against the loading arm, the pin 68 is urged by the camming action of the curved surface of the depression 69 to move into recess 72, so that the loading arm becomes simultaneously unlocked from the magazine body 40, and locked instead with the star wheel 46. Hence as the action of inserting the fifth round continues, the first round moves round into the opening 73. However, the first round is prevented from escaping through the opening 73 by the loading arm 63 locked to the star wheel 46 so that the semi-circular recesses 50, 51 together with those of the arms 64, 65, enclose the round over about three-quarters of its circumference.

When the trigger 6 is pulled with the magazine 2 loaded, the action is as follows. The link member 11 is moved rearwards and is hence forced to pivot anti-clockwise (as viewed in FIG. 1). The pivot 12 is thus forced to move upwards, so that the toggle mechanism comprising the first toggle bar 13 and the second toggle bar 17 begins to straighten. The breech block 15 is hence moved forward by virtue of the pivotal connection 14, carrying with it a round positively engaged behind the lip 39. As the breech block moves forward, the round slides longitudinally through its recesses 50, 51 to locate in the socket 83 in the barrel 1.

As the breech block moves forward, the firing pin 20 is held on the sear 29, so that the spring 22 becomes compressed between the firing pin 20 and the retaining pin 24. When the toggle mechanism 13, 17 reaches its fully straightened position, the round is fully engaged in the socket 83 and the breech block is safely locked against rearward movement. A small further trigger movement brings the toggle mechanism to a position where it is locked slightly over-centre with the upper surface of the second toggle bar 17 bearing on the pin 34 and pushing it upwards to disengage the sear 29 from the firing pin 20. The firing pin then shoots forward under the action of the spring 22, until it reaches the position shown in FIG. 1, where the thrust cap 23 bears on the shoulder 25. Thereafter the firing pin continues forward at high speed, under its own inertia, so that its hardened tip 20A strikes the percussion cap 77 to fire the round. It will be noted that the casing of the round is almost totally unsupported at the time of firing.

As the firing pin moves forward, it compresses the return spring 26 between the shoulders 27 and 28. As the firing pin approaches the firing position, the cheek 20B contacts the pin 21 and forces it outwards by a camming action on to the side surface of the firing pin 20. The outer end of the pin 21 now projects in front of the cam face 62, but only if the firing pin has shot fully forward to fire the round.

As the trigger 6 is released, it returns under the action of the leaf spring 8, the toggle mechanism 13, 17 is pulled down by the return of the link 11, and the breech block 15 is hence drawn back towards its original position, taking with it the firing pin 20, and the spent case of the fired round which is held by the lip 39.

During this return movement the firing pin remains in a forward position relative to the breech block (although retracted clear of the front face of the breech block by the spring 26). The pin 21 is thus held outwardly during the return movement by contact with the flank of the firing pin. As the breech block moves back, the pin 21 bears on the face 62 of the catch 57, to pull the catch backwards and disengage the hooked portion 61 from the adjacent tail 55. The star wheel assembly 46, 47 is thus freed from the catch 57 which now moves downwardly in its slotted pivot to clear the pin 21 and snap into position ready to catch the next succeeding tail 55. The star wheel assembly 46, 47 is restrained from rotation under the action of the springs 52, 53 until the spent case has cleared the socket 83 and the chamfered portion 85, and the breech block has cleared the star wheel 47. When this stage is reached, the star wheel assembly is freed to index forward under the action of the springs 52, 53 until the catch 57 engages the next succeeding tail 55. The spent case is thus automatically ejected through the opening 73, and the next round (if any) in the magazine is automatically indexed around into alignment with the breech block 15 and the socket 83 where it is ready to fire. It should be noted, however, that this sequence can occur only if the firing pin 20 has been released and moved forward to fire a round, thus countering the possibility of a live round being accidentally ejected.

When the breech is fully retracted the sear 29 moves under the bias of the sear spring 31 into engagement once more with the bent 33 on the firing pin.

As long as the magazine contains another round, the sequence can be repeated and all of the rounds in the magazine may thus be fired in rapid succession by repeated operation of the trigger.

If it is desired to remove rounds from the magazine without firing, this may be achieved by manually depressing the tail (visible in FIGS. 2 and 5) of the catch 57, whereupon the star wheels 46, 47 are released and the rounds are ejected automatically in sequence in similar manner to the ejection of rounds when spent. Further rotation of the star wheel assembly could release all torsional pre-stress in the springs 52, 53 and so detract from subsequent proper functioning of the magazine feed. This is prevented by the pin 68 coming against the cross pin 71 just after the last round is ejected.

We claim:

1. A firearm having a rotary magazine characterised by a magazine body defining around part of its circumference an opening through which a round of ammunition can be inserted or withdrawn, and around a remaining part of its circumference defining a circumferential restraint through which a round cannot be inserted or withdrawn;

a carrier rotatable within the body about a carrier axis and having radially extending portions adjacent pairs of which define positive locations in which a round of ammunition can be accommodated on insertion through the opening, rounds being slideable longitudinally in said positive locations;

resilient carrier biasing means for urging the carrier to rotate in a particular bias direction;

a guide member moveable across the opening;

said guide member having a guide surface facing against the bias direction so that a round inserted through the opening is guided into one of said positive locations and simultaneously rotates the carrier against its bias;

said guide member having a round-retaining surface facing in the bias direction which can co-operate with one of the positive locations to positively retain the first-inserted round against circumferential and radial movement; and restraining means for holding the guide member in a position such that the guide surface faces the opening whenever the carrier occupies the position corresponding to one in which the magazine contains less rounds of ammunition than its maximum capacity, the guide member being moveable against the bias direction during movement of the carrier corresponding to insertion of the final round so that the first-inserted round may then pass through the position occupied at other times by the guide means.

2. A firearm according to claim 1 characterised in that the restraining means comprises first locking means for positively locking the guide member to the body whenever the magazine contains less rounds of ammunition than its maximum capacity, the locking means being releasable automatically when the carrier moves against the bias direction as the final round is inserted.

3. A firearm according to claim 2 characterised in that second locking means are provided for positively locking the guide member to the carrier during insertion of the final round when the first-inserted round is positively held between its positive location in the carrier and the round-retaining surface of the guide member.

4. A firearm according to claim 3 characterised in that the first and second locking means comprise detent member slideable in a bore passing through the guide member in the direction of the carrier axis, said detent member being of such a length as to project from a surface of the guide member at all times, a projecting end of the detent member being constrained by contact of its other end with an end face of the carrier to remain within a first depression in the body whenever the carrier occupies a position corresponding to one in which the magazine contains less rounds of ammunition than its maximum capacity, a second depression being provided in the said end face of the carrier into which the said other end of the detent member can move so that it clears the first depression during movement of the carrier corresponding to insertion of the final round.

5. A firearm according to claim 4 characterised in that means are provided for limiting the maximum rotation of the carrier relative to the magazine body.

6. A firearm according to claim 5 characterised in that the means for limiting the maximum rotation of the carrier is in the form of a stop on the carrier which cannot pass the detent member.

7. A firearm according to claim 6 characterised in that there is provided an annular groove in the end face of the carrier into which the detent member is constrained at all times to project by contact with the body, the second depression being provided in the base of the annular groove and the stop being in the form of an obstruction in the groove.

8. A firearm according to claim 1 characterised by carrier indexing means for holding the carrier in positions such that each successive round of ammunition can be held against the carrier biasing means aligned in the breech with the barrel.

9. A firearm according to claim 8 characterised in that the carrier indexing means is a ratchet device acting between the carrier and the body.

10. A firearm according to claim 8 characterised by a longitudinally moveable breech block which can push forward a round of ammunition in a positive location in the carrier aligned with the barrel to engage the round positively with the breech end of the barrel.

11. A firearm according to claim 10 characterised by a longitudinally moveable firing pin which can move forward to strike the rear face of a round of ammunition only when the breech block occupies a forward position.

12. A firearm according to claim 11 characterised in that the firing pin has a mechanical interaction with the carrierindexing means such that after the breech block has pushed a round of ammunition fully forward and the firing pin has reached a forward position in which it can fire the round of ammunition, the carrier indexing means is disengaged to permit the carrier to turn to a position where the next successive round is brought into alignment with the breech.

13. A firearm according to claim 12 characterised in that the carrier indexing means comprises a catch having a slotted pivotal mounting on the body, the catch being biased towards a position where it engages one of a number of spaced projections on the carrier to restrain rotation thereof, and the said mechanical interaction comprises means for disengaging the catch when the firing pin is retracted with the breech block from its most forward position, the catch immediately returning by reason of its slotted pivotal mounting to a position clear of the said one projection where it can engage the next succeeding projection on subsequent rotation of the carrier under its resilient bias.

14. A firearm according to claim 13 characterised in that the breech block has a lip which can engage around the rim of a round aligned therewith, so that after firing the spent case of a round can be withdrawn longitudinally by rearward movement of the breech block.

* * * * *